US006743036B2

(12) United States Patent
Lauter et al.

(10) Patent No.: US 6,743,036 B2
(45) Date of Patent: Jun. 1, 2004

(54) FLAT FLUORESCENT LIGHT COMPRISING A CONTACT SYSTEM

(75) Inventors: Friedrich Lauter, Augsburg (DE); Matthias Schweizer, Hollenbach (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 54 days.

(21) Appl. No.: 10/258,864

(22) PCT Filed: Feb. 13, 2002

(86) PCT No.: PCT/DE02/00512

§ 371 (c)(1),
(2), (4) Date: Oct. 29, 2002

(87) PCT Pub. No.: WO02/078132

PCT Pub. Date: Oct. 3, 2002

(65) Prior Publication Data

US 2003/0153206 A1 Aug. 14, 2003

(30) Foreign Application Priority Data

Mar. 8, 2001 (DE) ..... 101 11 191

(51) Int. Cl.[7] ..... H01R 33/02

(52) U.S. Cl. ..... 439/329; 349/152; 439/817; 439/889

(58) Field of Search ..... 439/226, 329, 439/817, 889; 349/152, 149

(56) References Cited

U.S. PATENT DOCUMENTS

| | | | | |
|---|---|---|---|---|
| 3,922,051 A | * | 11/1975 | Reynolds | 439/59 |
| 4,767,361 A | | 8/1988 | Hoshino et al. | |
| 5,604,410 A | | 2/1997 | Vollkommer et al. | |
| 5,934,927 A | | 8/1999 | Nagai | |
| 6,034,470 A | * | 3/2000 | Vollkommer et al. | 313/485 |
| 6,323,600 B1 | | 11/2001 | Stanic et al. | |
| 6,388,374 B1 | | 5/2002 | Vollkommer et al. | |

* cited by examiner

*Primary Examiner*—Neil Abrams
*Assistant Examiner*—Phuong K T Dinh
(74) *Attorney, Agent, or Firm*—Robert F. Clark

(57) ABSTRACT

A flat fluorescent light (1), comprises a discharge vessel that is composed of a based plate (3), face plate (4) and frame (5). A contact system (2) for connecting an electric power supply device by connection lines is integrated into the narrow side of the flat fluorescent light. An insulation body, provided with U-shaped contact sections is located between a section of the base plate (3) and face plate (4), the section acting as a receptacle and projecting beyond the frame (5) of the discharge vessel. The contact surface of the contact sections are connected to the electrodes of the flat florescent light by connection surfaces of the receptacle. The connection parts of the contact sections are connected to the connection lines.

14 Claims, 8 Drawing Sheets

FLAT FLUORESCENT LIGHT COMPRISING A CONTACT SYSTEM

TECHNICAL FIELD

The present invention relates to a flat radiator.

In the present context, the term flat radiator is intended to mean radiators which are based on electric gas discharges, in particular are based on dielectric barrier gas discharges, with a sheet-like geometry, which emit electromagnetic radiation both in the invisible region, for example ultraviolet (UV) or infrared (IR) radiation, and also in the visible region, i.e. light. In the latter case, the term "flat lamp" is also in widespread use. The light can also be generated by conversion of UV radiation by means of phosphors.

In the case of the flat radiators which are designed for dielectric barrier discharges, either the electrodes, which are usually in strip form, of at least one polarity (for unipolar operation) or all the electrodes, i.e. the electrodes of both polarities (for bipolar operation), are separated from the gas fill, which is used as discharge medium, by means of a dielectric layer (one-sided or two-sided dielectric barrier discharge). Electrodes of this type are also referred to below as "dielectric electrodes" for short.

PRIOR ART

The document WO98/43277 has already disclosed a flat radiator for the background illumination of liquid crystal displays (LCDs). This flat radiator has a baseplate, a cover plate and a frame, which are connected to one another in a gastight manner by means of solder to form a discharge vessel. Structures which are similar to conductor tracks function as electrodes in the interior of the discharge vessel, as lead-throughs in the lead-through region and as external power supply conductors in the outer region. The flat radiator is connected to a pulsed voltage source, which acts as an electrical power supply unit, via the power supply conductors.

The direct connection between flat radiator and supply unit, which is less suitable for flexible and automated manufacture of the system, represents a drawback.

SUMMARY OF THE INVENTION

It is an object of the present invention to provide an improved contact system for a flat radiator, which is used for connection to an electrical supply unit.

This object is achieved by the features of claim 1. Particularly advantageous configurations are given in the dependent claims which refer back to claim 1.

In addition, a flat radiator having the contact system according to the invention, in accordance with claims 9 to 13, and a system having a flat radiator of this type and an electrical supply unit in accordance with claim 14 are claimed.

The electrical contact system according to the invention comprises a contact part with a U-shaped section, an insulating body, on which the U-shaped section of the contact part is mounted, and a receptacle for the insulating body with the mounted contact part. The U-shaped section of the contact part has two side walls and a connecting wall which connects these two side walls, the outer side of the connecting wall forming a contact surface. The U-shaped section of the contact part partially engages around at least a partial region of the insulating body. The contact part also comprises a connection part for an electrical connection line. For its part, the receptacle comprises two plates or at least a partial region of two plates, which are arranged at a distance from one another and, at least in sections, parallel to one another, which is suitable for this purpose, as well as an electrical connection face, which is arranged on one of the two mutually facing surfaces of the two plates. The insulating body is arranged with the mounted contact part between the two plates, in such a manner that the contact surface of the contact part is in electrically conductive contact with the connection face of the receptacle.

To increase the compressive force between the contact surface of the contact part and the connection face of the receptacle, a spring element is preferably arranged between the insulating body and that side of the U-shaped section of the contact part which is at the rear with respect to the contact surface. To allow contact part and insulating body to press onto the two plates (plate partial regions) of the receptacle by means of the force of this spring element, it is expedient, at least during mounting, for the contact part to be fitted only relatively loosely onto the body. Before being fitted into the receptacle, the insulating body and the contact part mounted thereon are pressed together, counter to the spring force of the spring element, until both components can be inserted into the receptacle. After the insertion has taken place, the load on the compressed spring element can be relieved, and the latter can build up the compressive force mentioned above. The spring element may either be formed separately from the contact part, for example in the form of a coil spring, or may be integrated in the contact part, for example in the form of a spring tongue, optionally even in single-piece form.

To prevent the two components from unintentionally becoming detached from one another, it is advantageous to provide the relevant region of the insulating body with at least one latching lug, preferably with one or two latching lugs on each side wall of this region. Accordingly, one or, if appropriate, both of the side walls of the U-shaped section of the contact part is/are provided with corresponding apertures for the associated latching lugs of the insulating body to latch into.

A further advantage of the use of one or more spring elements in the manner described above consists in the fact that in this way it is possible to compensate for tolerances in the distance between the partial regions of the plates which form the receptacle. Specifically, the application of pressure and consequently contact-making between the contact surface of the contact part and the connection face of the receptacle is ensured over the spring excursion of the spring element.

To facilitate sliding mounting of the U-shaped contact part, it is also advantageous for the corresponding edges of the insulating body to be provided with a bevel.

To improve the contact, the contact surface of the contact part may be soldered to the connection face of the receptacle, for example by means of HF soldering. To assist the soldering operation, it may be of assistance for the contact surface to have at least one bore in which solder is deposited.

The contact system is preferably equipped with more than one contact part, specifically with the same number of contact parts as there are corresponding connection surfaces on the receptacle or as there are electrical connection lines provided. By way of example, for two connection lines two contact parts are mounted on an insulating body in the manner described above.

One or more of the contact systems according to the invention explained above are integrated in a narrow side of a flat radiator of the type described in the introduction. In this way it is also possible, for example, for a plurality of groups of electrodes to be actuated independently of one another within the flat radiator, instead of a single electrode system. Moreover, in particular for large flat radiators, for example those with a diagonal of 20 inches or more, it may be advantageous to use more than one group of electrodes. This is because in this way it is possible to make the electrical supply to large radiators modular, by ensuring the total electric power uptake with the aid of a plurality of relatively low-power ballasts, in which case each individual ballast supplies a group of electrodes provided for this purpose. This has the advantage, inter alia, that the electrical ballasts belonging to smaller flat radiators can be used for large flat radiators. For details in connection with flat radiators with groups of electrodes, reference should be made, in addition, to EP-A 0 926 705.

It is preferable for one or each contact system to be integrated in a flat radiator in such a manner that a receptacle for the corresponding contact system is formed by an associated part of baseplate and front plate which projects beyond the frame of the discharge vessel.

Typically, two electrodes or bus conductor tracks which connect a plurality of electrodes from the electrode system or, if appropriate, each group of electrodes are led to the outside from inside the discharge vessel. The end piece of each electrode or bus conductor track there serves as a connection face for the receptacle and is preferably matched to the shape of the contact surface of the contact part.

The insulating body on which the contact part or contact parts has/have been mounted is inserted in the partial region between baseplate and front plate which serves as a receptacle, in such a manner that the or each contact surface is arranged, in an electrically connecting manner, above the corresponding end piece, which serves as a connection face. It is preferable for the components of the contact system to be designed and dimensioned in such a manner that there is space for the entire contact system in the narrow side of the flat radiator within the receptacle provided for this purpose. This has the advantage that this narrow side of the flat radiator can be covered with a diaphragm to protect against contact or for esthetic reasons.

In addition, the entire illumination system also has at least one electrical ballast, which is/are connected to the corresponding connection parts of the (respective) contact system by means of electrical connection lines.

DESCRIPTION OF THE DRAWINGS

The invention is to be explained in more detail below with reference to an exemplary embodiment. In the figures:

FIGS. 1*a*, 1*b* show a diagrammatic plan view or side view of a flat radiator 1 based on a dielectric barrier discharge with a contact system 2 according to the invention. The discharge vessel of this flat radiator is coated with a layer of phosphor on its inner side and is suitable in particular for the backlighting of liquid crystal displays (LCDs). Since the details of the structure of the flat radiator are of only subordinate importance with regard to gaining an understanding of the invention, reference is made in this connection to the document WO 98/43277, which has already been cited, in particular to FIGS. 3*a*, 3*b* with the associated description of these figures.

Figure 1B:
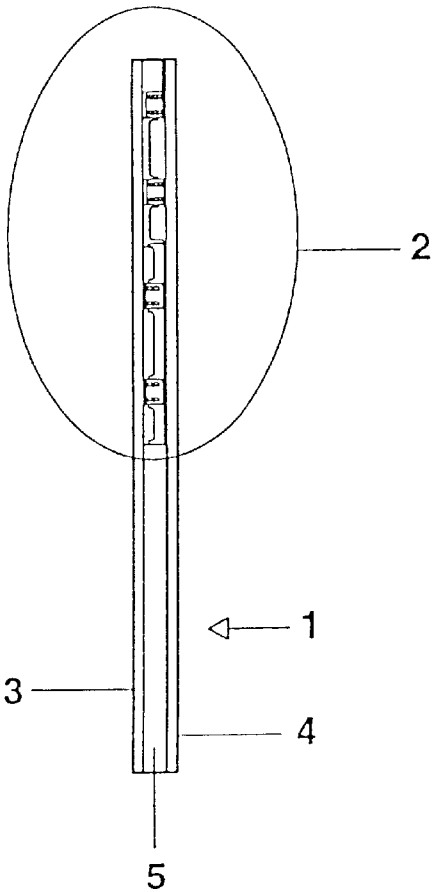
FIG. 1*b* shows a diagrammatic side view of the flat radiator from FIG. 1*a* with a contact system fitted in the narrow side of the flat radiator.

The contact system 2 is integrated in a narrow side of the flat radiator 1, specifically outside the actual discharge vessel, which is defined by baseplate 3, front plate 4 and a frame 5 connecting the two plates, but between the partial region of the baseplate 3 and front plate 4 which is extended beyond the frame 5 and serves as a receptacle.

Figure 1A:
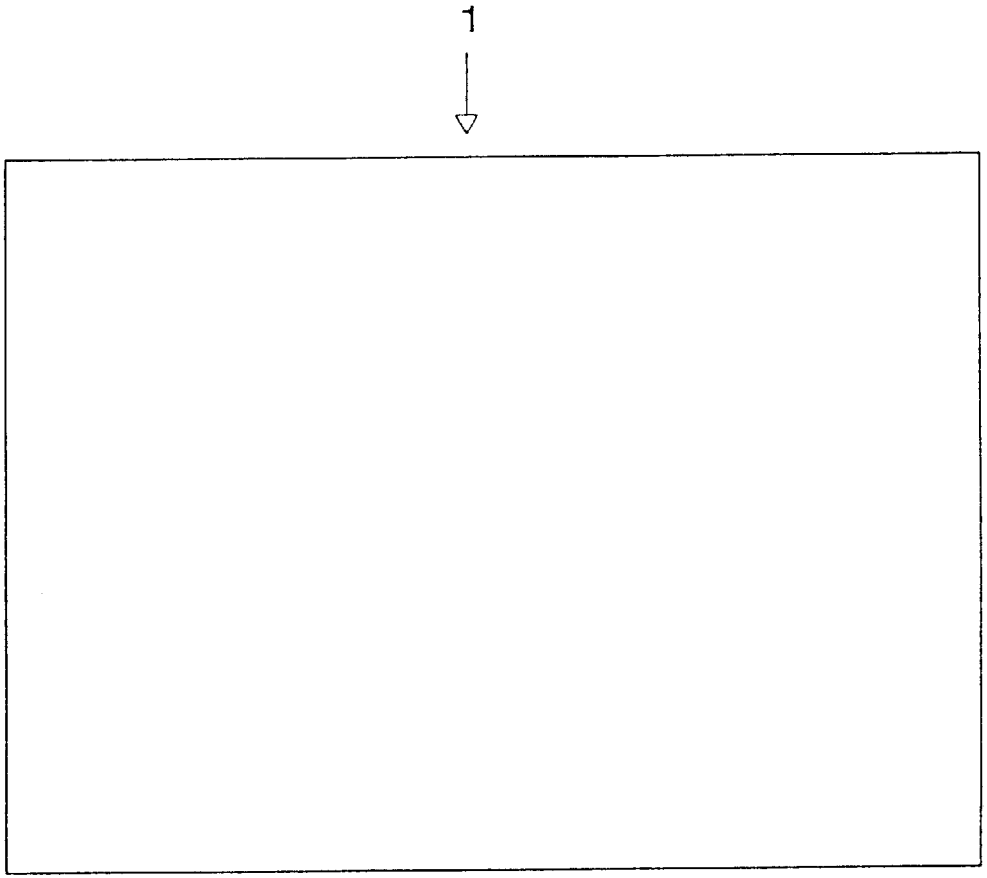
FIG. 1*a* shows a diagrammatic plan view of a flat radiator.
Figure 2A:
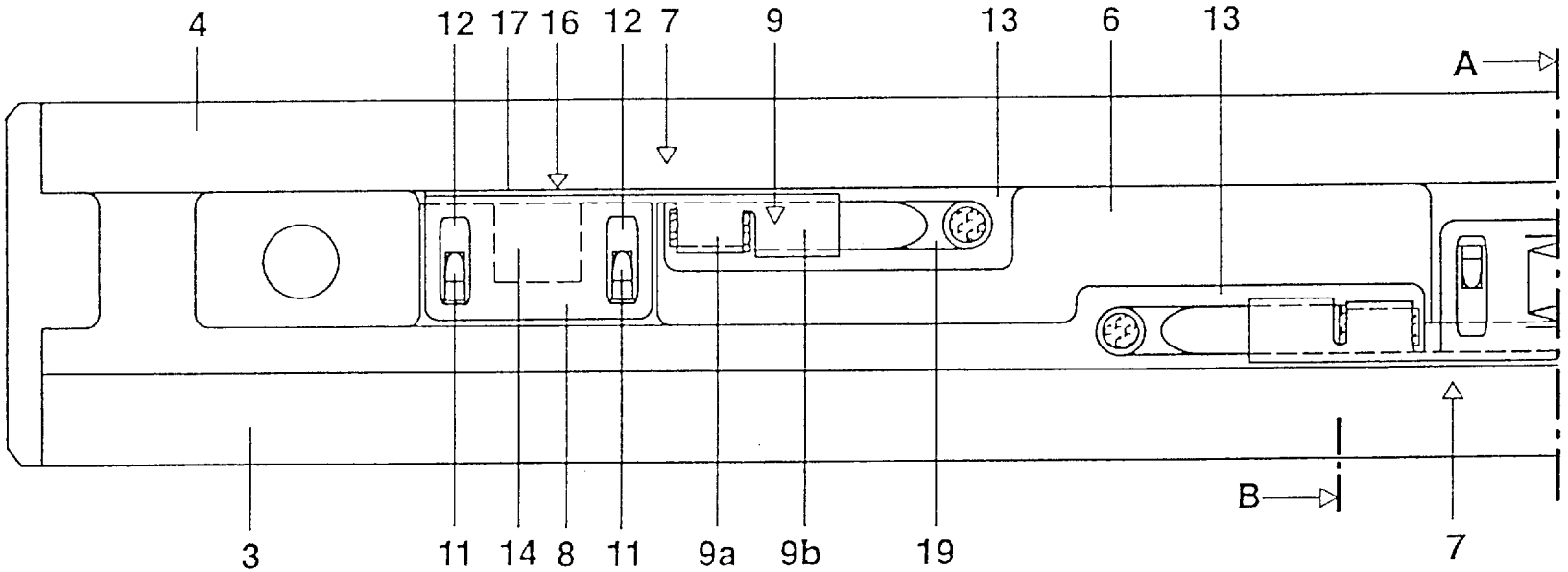
FIG. 2*a* shows an enlarged view of the narrow side of the flat radiator, showing a partial region of the contact system.
Figure 2B:
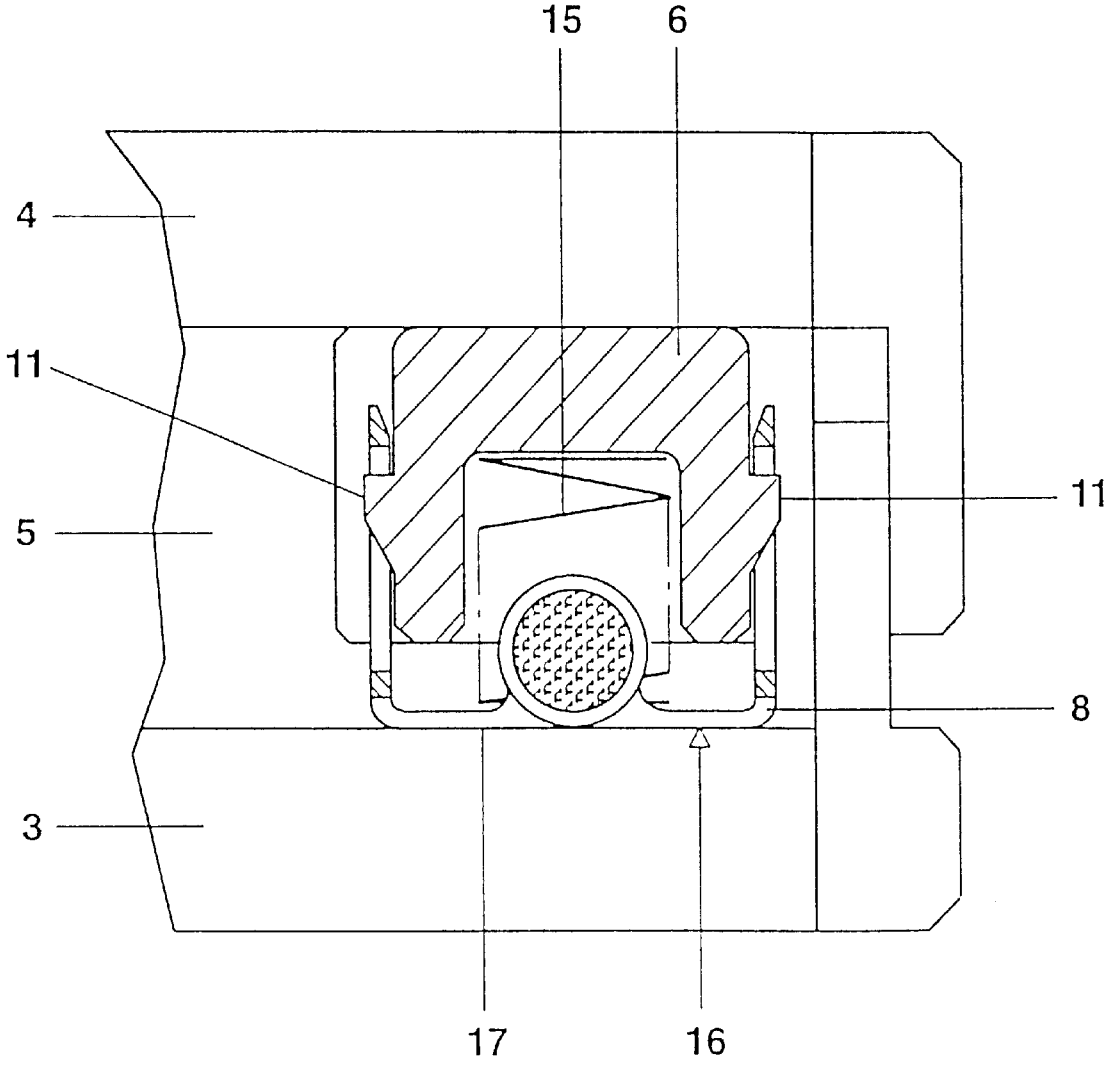
FIG. 2*b* shows a sectional illustration, on line AB, of part of the flat radiator from FIG. 2*a,*
Figure 3A:
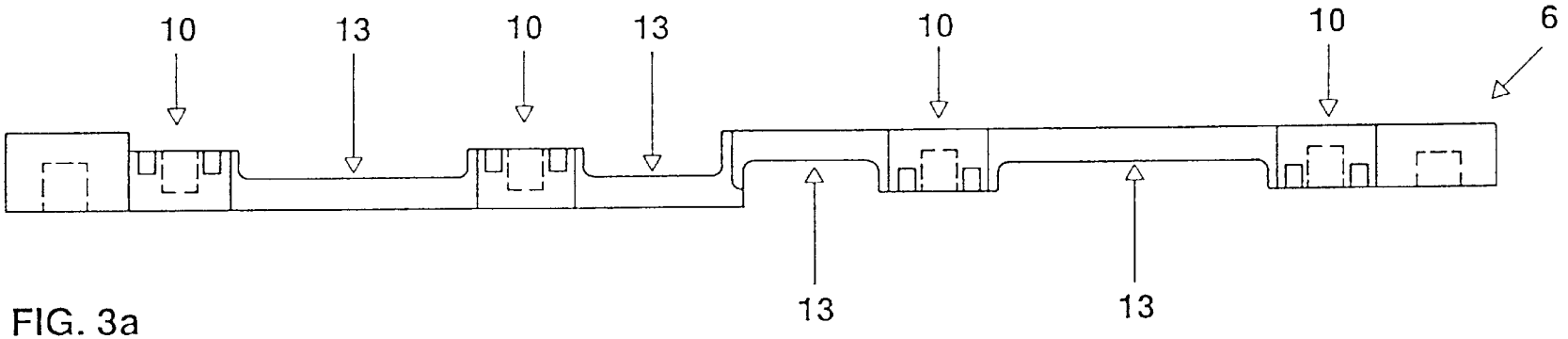
FIG. 3*a* shows a side view of an insulating body of the contact system.
Figure 3B:
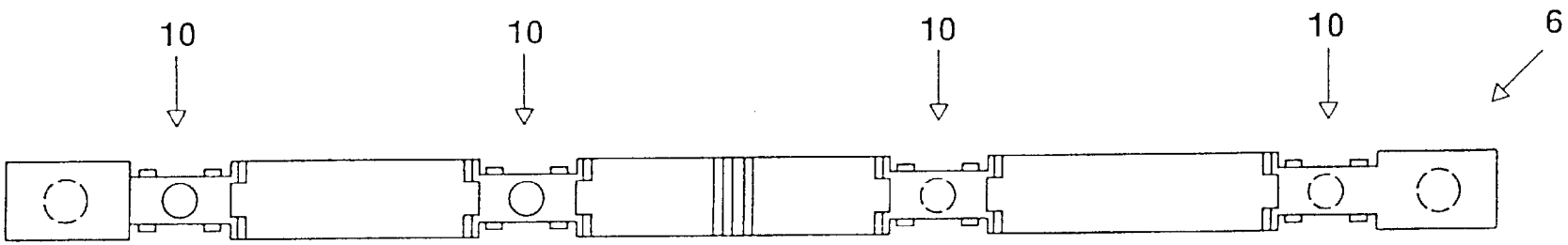
FIG. 3*b* shows a plan view of the insulating body from FIG. 3*a,*
Figure 3C:
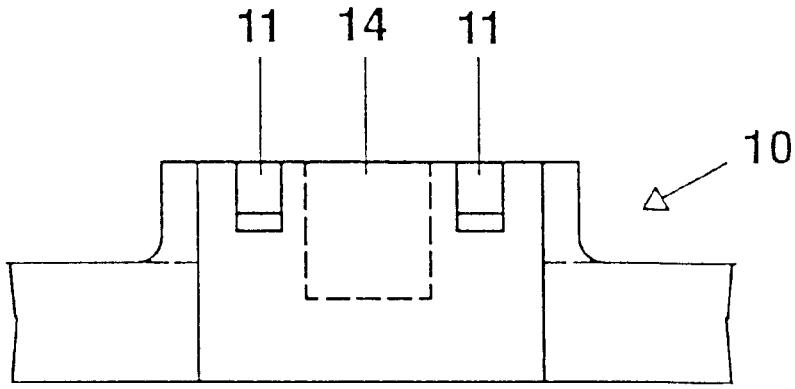
FIG. 3*c* shows an enlarged excerpt of the side view from FIG. 3*a*, illustrating the region of the insulating body which is provided for mounting of the contact part.
Figure 3D:
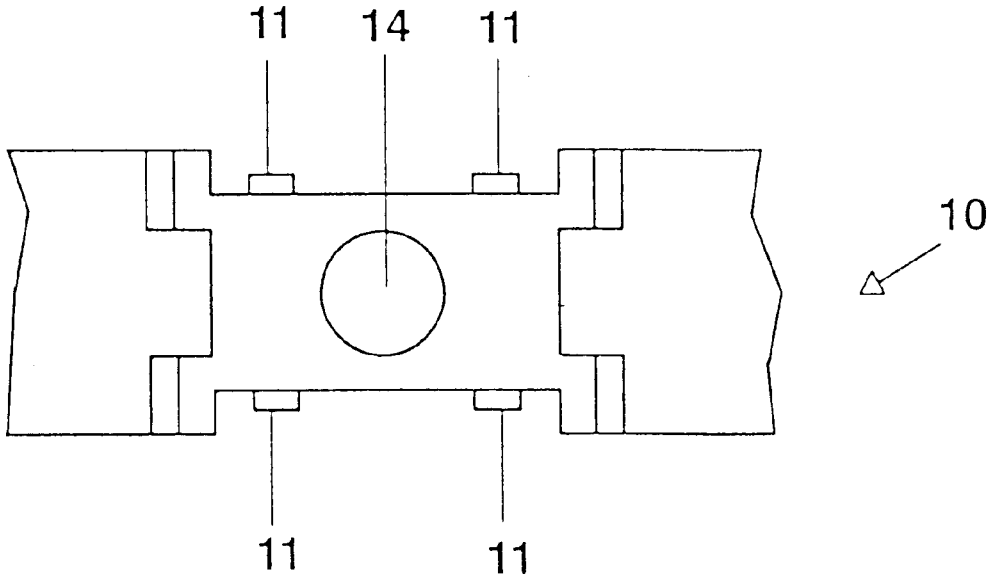
FIG. 3*d* shows an enlarged excerpt of the plan view from FIG. 3*b*, illustrating the region of the insulating body which is provided for mounting of the contact part.

This can be seen in more detail from FIGS. 2*a*, 2*b*, which show an enlarged illustration of the partial region of the narrow side of the flat radiator with the contact system (in part) and a sectional illustration on line AB, respectively. In these figures, identical features to those shown in figs 1*a*, 1*b* are provided with identical reference numerals. The contact system comprises, in addition to the partial region of the baseplate 3 and front plate 4 which serves as a receptacle, an elongate insulating body 6 and a total of four contact parts 7 which are produced from metal sheet (material: CuSn 6; surface: NiZnPbAg-coated). Each contact part 7 has a U-shaped section 8, which merges into an elongate connection part 9.

Figure 4:
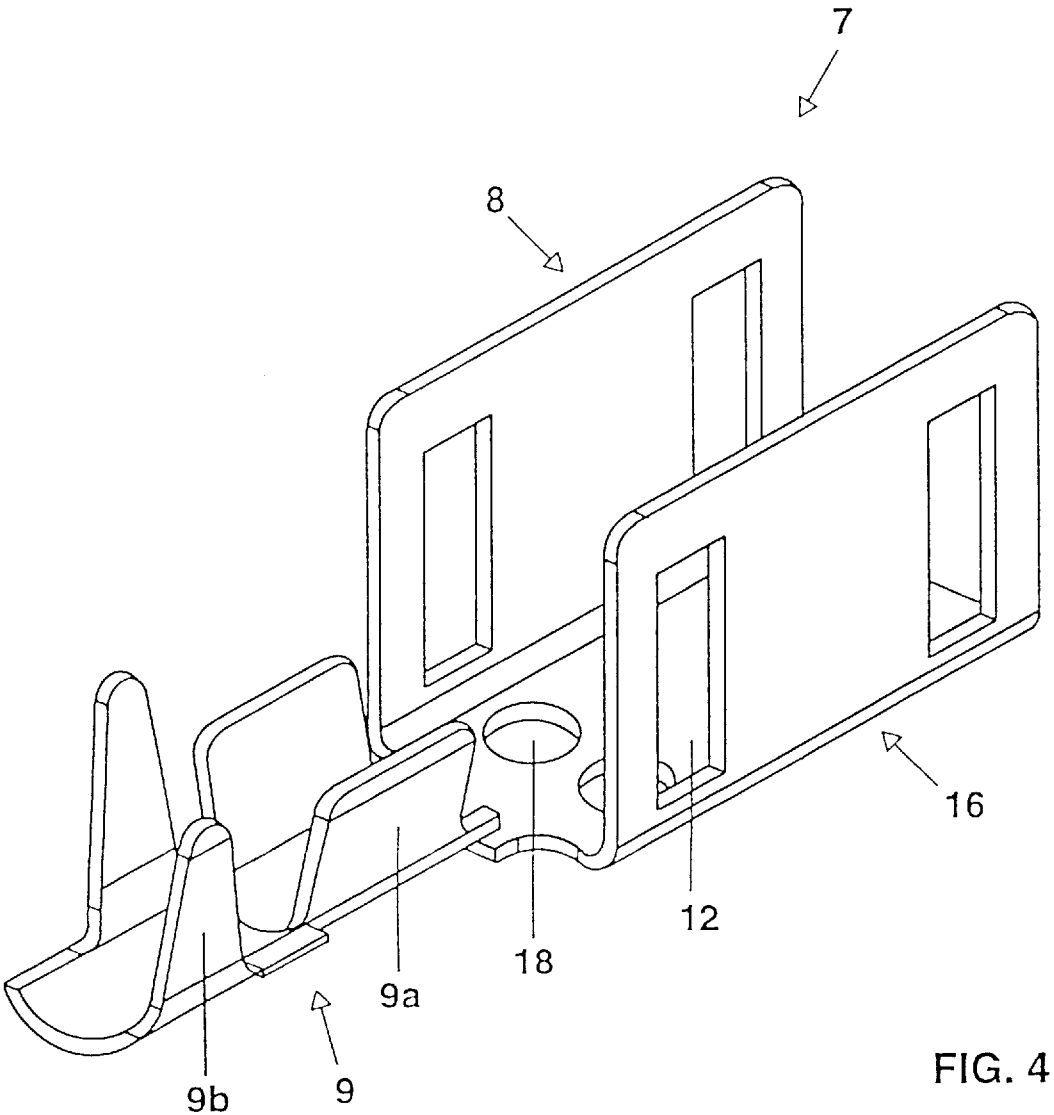
FIG. 4 shows an illustration of the contact part of the contact system.

For the explanations given below, reference is also made to FIGS. 3*a* to 3*d*, which show various views of the insulating body 6, and to FIG. 4, which shows an illustration of the contact part 7.

The insulating body 6, which comprises polycarbonate with a glass fiber content of 20%, has a total of four regions 10 which are substantially rectangular. Each region 10 is intended to receive the U-shaped section 8 of in each case one of the four contact parts 7. For this purpose, each region 10 has, on its two opposite sides, in each case two latching lugs 11 which, during mounting, engage in associated rectangular apertures 12 in the side walls of the U-shaped section 8 of the corresponding contact part 7. Furthermore, each of said regions 10 of the insulating body 6 is adjoined by an elongate recess 13, into which, in the mounted state, in each case the connection part 9 assigned to the U-shaped section 8 extends. Furthermore, each region 10 of the insulating body 6 is provided with a bore 14, in which, in the mounted state, in each case one spring 15 is arranged. After the contact system 2 has been fitted into that part of the edge region of the flat radiator 1 which serves as a receptacle, each spring 15 presses the insulating body 6 and the associated contact part 7 which has been fitted onto it apart and toward the corresponding inner side of the respective plate 3, 4. In the process, the contact surface 16, which is remote from the insulating body 6, of the U-shaped section 8 of each contact part 7 is electrically conductively connected to an associated connection face 17. To this extent, these connection faces 17, of which there are a total of four, are to be regarded as parts of the receptacle. Each of these four connection faces 17 is developed from an end piece of an electrical bus conductor track which is applied to the inner wall of the baseplate or front plate and is in each case guided out of the interior of the discharge vessel to the outside (not shown). Inside the discharge vessel, each bus conductor track connects a plurality of electrodes which are in strip form and are likewise applied to the inner wall of the baseplate or front plate. For further details of the electrode structure, which is in any case not directly related to the invention, and of the dielectric coating of this electrode structure, reference is made to WO 98/43277, which has already been cited. The shape of each connection face 17 is substantially matched to the shape of the contact surface 16 of the corresponding contact part 7. To improve the contact-making, each connection face 17 is connected to the associated contact surface 16 with the aid of an electrically conductive solder, for example by HF soldering. Four bores 18 in the connecting wall, which comprises the contact surface 16, of the U-shaped section 8 of the contact part 7 (only two bores can be seen in the illustration shown in FIG. 4) are used in this context for the deposition of additional tin solder stock. Each connection part 9 has two regions 9*a*, 9*b* which, in the mounted state, clamp around the flex or insulating sheath of a connection line 19. The other end of each connection line 19 is connected to an output pole of an electrical pulsed source, which is suitable for introducing pulsed active power, which is known to be particularly efficient from EP-A 0 733 266. Electrical pulsed sources of this type are known, for example, from WO 99/05892. In this way, the two separate groups of electrodes (not shown) of the flat radiator 1 can be actuated separately via in each case two connection lines.

Figure 5:
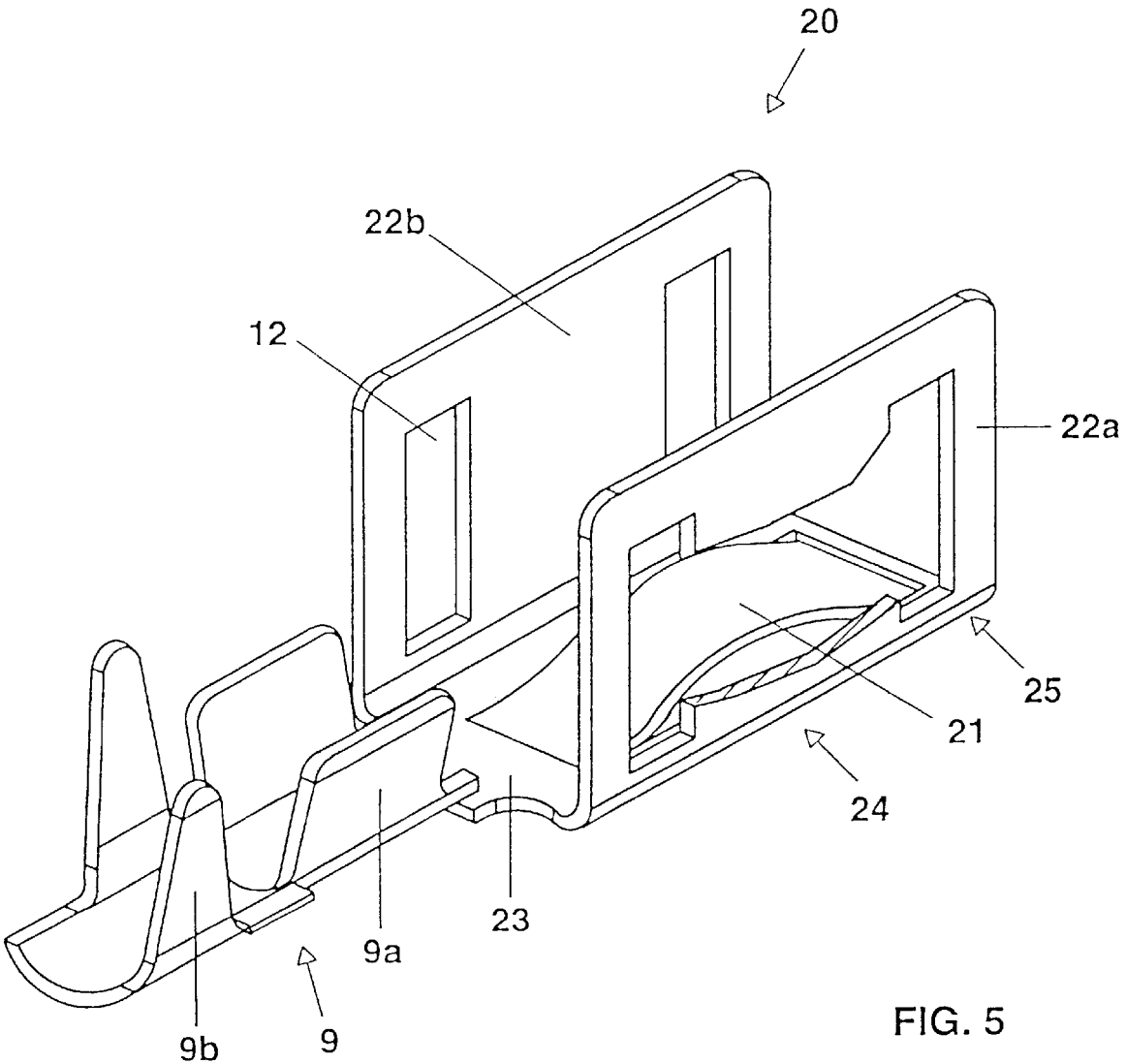
FIG. 5 shows an illustration of a further embodiment of the contact part of the contact system.

FIG. 5 shows an illustration of a further embodiment of the contact part of the contact system, in which identical features are provided with identical reference numerals. Unlike the embodiment illustrated in FIG. 4, the contact part 20 has a leaf spring 21 acting as the spring element. The leaf spring 21 is inserted in a rectangular recess in the connecting wall 23, which connects the two side walls 22*a*, 22*b*, of the U-shaped section 24 of the contact part 20. Moreover, the leaf spring 21 is curved in the direction away from the contact surface 25 of the contact part 20. As a result, at least in the event of small tolerances in the distance between baseplate 3 and front plate 4, it is possible to dispense with the coil spring 15 which is mentioned in the description relating to FIGS. 2*a*, 2*b* and 3*a* to 3*d* (cf. also FIG. 2*b*).

Figure 6:
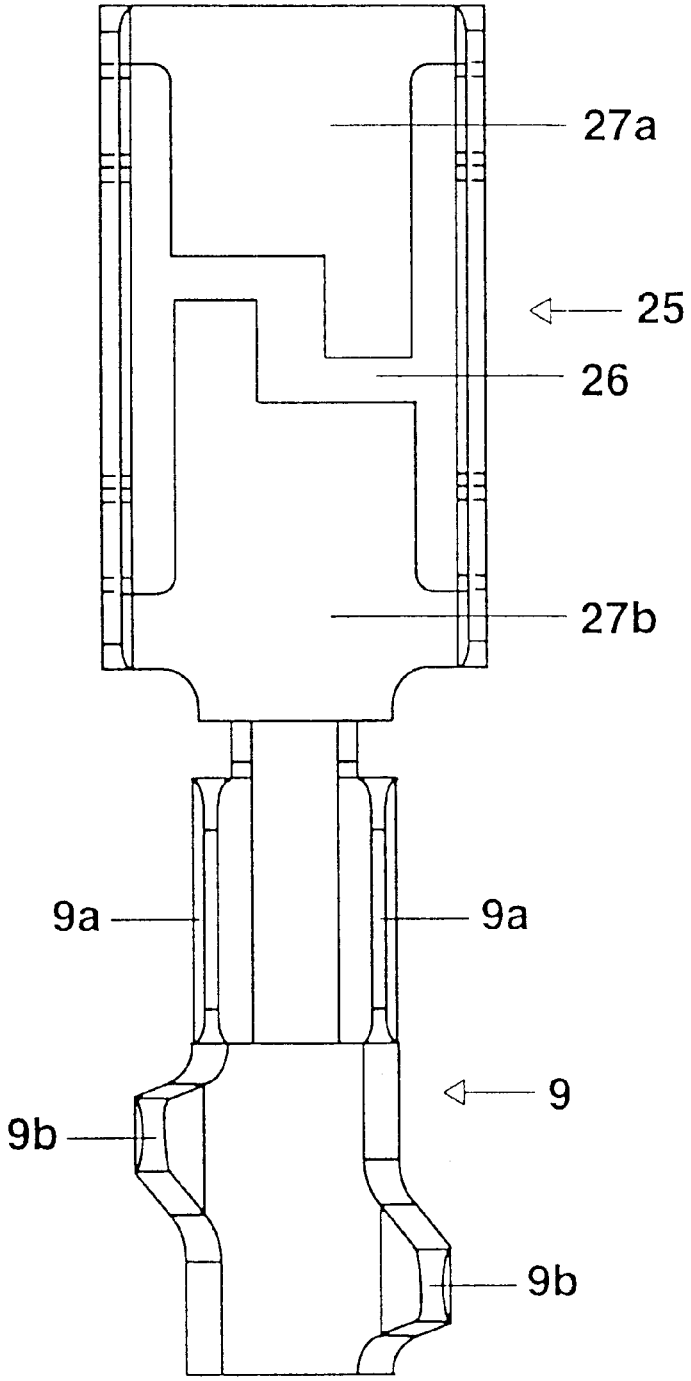
FIG. 6 shows an illustration of a further embodiment of the contact part of the contact system.

FIG. 6 shows an illustration of a further embodiment of the contact part of the contact system, in which, once again, identical features are provided with identical reference numerals. In this embodiment, the connecting wall (and consequently also the contact surface, which cannot be seen in FIG. 6) of the contact part 25 is divided into two parts 27*a*, 27*b* by means of an expansion joint 26. Only one of the two partial surfaces 27*a*, 27*b* is soldered to the connection face 17 mentioned above. Consequently, in absolute terms, the expansion is less than in the case of a single-part connecting wall, since a percentage expansion which corresponds to a defined change in temperature relates only to the shorter length of the partial surface 27*a* or 27*b*. The expansion joint 26 is substantially in the shape of an "H", except that the transverse line joining the two upright lines of this "H" are stepped. This particular shape of the transverse line effectively prevents the coil spring 15 mentioned above from being able to become jammed in the expansion joint 26 during mounting.

What is claimed is:

1. An electrical contact system, having a contact part (7; 20) having a U-shaped section (8; 24), comprising two side walls and a connecting wall which connects these two side walls, the outer side of the connecting wall having a contact surface (16; 25), a connection part (9) for an electrical connection line, an insulating body (6), on which the U-shaped section (8; 24) of the contact part (7; 20) is mounted, in the process engaging partially around at least a partial region of the insulating body (6), a receptacle for the insulating body (6) with the mounted contact part (7; 20), having two plates (3, 4) or at least a part of two plates (3, 4) which are arranged at a distance from one another and, at least in sections, parallel to one another, an electrical connection face (17) which is arranged on one of the two mutually facing surfaces of the two plates (3, 4), the insulating body (6) being arranged with the contact part (7; 20) between the two plates (3, 4), in such a manner that the contact surface (16; 25) of the contact part (7; 20) is in electrically conductive contact with the connection face (17) of the receptacle.

2. The contact system as claimed in claim 1, in which the cross section of the insulating body (6), at least in the region (10) which is provided for the contact part (7; 20), is substantially rectangular, and at least one side wall of the insulating body (6) within this region (10) has at least one latching lug (11), and at least one side wall of the U-shaped section (8; 24) of the contact part (7; 20) has at least one aperture (12) for in each case one associated latching lug (11) of the insulating body (6) to latch into.

3. The contact system as claimed in claim 1, in which the contact part (7; 20) is produced from the material CuSn 6, and the surface of the contact part (7; 20) consists of NiZnPbAg.

4. The contact system as claimed in claim 1, in which the contact surface (16; 25) of the contact part (7; 20) is soldered to the connection face (17) of the receptacle.

5. The contact system as claimed in claim 1, in which a spring element (15; 21) is arranged between the insulating body (6) and that side of the U-shaped section (8; 24) of the contact part (7; 20) which lies at the rear with respect to the contact surface (16; 25).

6. The contact system as claimed in claim 1, in which the edges of the insulating body which face the U-shaped contact part have a bevel to allow sliding mounting of the two components.

7. The contact system as claimed in claim 1, in which the insulating body (6) consists of polycarbonate with a glass fiber content of 20%.

8. The contact system as claimed in claim 1, having more than one contact part (17; 20).

9. A flat radiator (1), having a discharge vessel which surrounds a discharge medium, having a baseplate (3), a front plate (4) and a frame (5) which connects the two plates (3, 4) to one another in a gastight manner, electrodes which are arranged on the surface of at least the baseplate, characterized by at least one contact system (2) as claimed in claim 1.

10. The flat radiator as claimed in claim 9, in which the receptacle of the contact system is formed by a part of baseplate (3) and front plate (4) which projects beyond the frame (5).

11. The flat radiator as claimed in claim 10, in which at least one electrode or, if appropriate, a bus line connecting a plurality of electrodes, is led out of the interior of the discharge vessel to the outside, where it is developed further, on the projecting part of the baseplate (3) or front plate (4), as a connection face (17) of the receptable of the contact system (2).

12. The flat radiator as claimed in claim 9, in which the contact system (2) comprises two or more contact parts (7; 20) which are mounted on a common insulating body (6).

13. The flat radiator as claimed in claim 9, in which the electrodes are of strip-like design and, in order to produce a dielectric barrier discharge, are at least in part separated from the discharge medium by a dielectric layer.

14. An illumination system having the flat radiator as claimed in claim 9, in which the connection part of the contact part of the contact system is connected to an electronic supply unit via electrical connection lines.

* * * * *